US009661879B1

(12) United States Patent
Gurr et al.

(10) Patent No.: US 9,661,879 B1
(45) Date of Patent: May 30, 2017

(54) CELL PHONE COMPARTMENT IN MOLDED CUP

(71) Applicants: Carlos K. Gurr, Cedar Hills, UT (US); Kendyl A. Roman, Sunnyvale, UT (US)

(72) Inventors: Carlos K. Gurr, Cedar Hills, UT (US); Kendyl A. Roman, Sunnyvale, UT (US)

( * ) Notice: Subject to any disclaimer, the term of this patent is extended or adjusted under 35 U.S.C. 154(b) by 0 days.

(21) Appl. No.: 15/055,962

(22) Filed: Feb. 29, 2016

(51) Int. Cl.
*A41C 3/00* (2006.01)

(52) U.S. Cl.
CPC ..... *A41C 3/0035* (2013.01)

(58) Field of Classification Search
CPC ..... A41C 3/00; A41C 3/10; A41C 3/0035; A41C 3/0057; A41C 3/0014; A41C 3/02; A41C 3/148
USPC ..... 450/89, 39, 54–57; 623/7, 8; 2/247, 2/250, 267, 268
See application file for complete search history.

(56) References Cited

U.S. PATENT DOCUMENTS 1,391,936 A * 9/1921 Bosky ..... A41C 3/00 450/1
2,436,430 A * 2/1948 Hart ..... A41C 3/0035 2/250
2,492,862 A * 12/1949 Harvey ..... A41C 3/0035 150/101
2,503,847 A * 4/1950 Shanahan ..... A41C 3/0035 224/638
2,610,325 A * 9/1952 Schlussel ..... A41C 3/00 2/247
2,624,881 A * 1/1953 Lee ..... A41C 3/0035 2/247
5,098,330 A * 3/1992 Greenberg ..... A41C 3/10 450/31
5,496,205 A * 3/1996 Lee ..... A41C 3/0035 2/247
6,099,382 A * 8/2000 Wilson ..... A41C 3/0035 2/247
6,176,761 B1 * 1/2001 Underhill ..... A41C 3/0014 450/1
6,517,410 B1 * 2/2003 Underhill ..... A41C 3/0057 450/1
6,626,733 B1 * 9/2003 Knutson ..... A41C 3/0057 2/247
7,309,275 B1 * 12/2007 Morales ..... A41C 3/02 450/38
D597,279 S * 8/2009 Spillman ..... D2/706
7,753,759 B2 * 7/2010 Pintor ..... A41C 3/0035 450/54
8,597,072 B1 * 12/2013 Lucas ..... A41C 3/0035 2/247
2007/0161328 A1 * 7/2007 Munn ..... A41C 3/148 450/1

(Continued)

*Primary Examiner* — Gloria Hale

(57) ABSTRACT

A cell phone compartment is provided in a molded cup. A pocket space is formed in the molded cup. The molded cup can be incorporated into a bra or be provided as a standalone padded pocket. A bra with an integral pocket or case is easily and discreetly accessed. The phone is placed in the pocket and accessed through an opening. In some embodiments a channel is formed between the opening and the pocket. The pocket may comprise a rigid case and/or a protective shield. The molding acts as padding to increase comfort and smooth appearance on the outside convex surface of the bra cup.

20 Claims, 7 Drawing Sheets

SIDE VIEW CROSS SECTION

(56) References Cited

U.S. PATENT DOCUMENTS

| | | | | |
|---|---|---|---|---|
| 2008/0176485 | A1* | 7/2008 | Linkon | A41C 3/144<br>450/57 |
| 2008/0261489 | A1* | 10/2008 | Sweeney | A41C 3/0035<br>450/39 |
| 2009/0104845 | A1* | 4/2009 | Pintor | A41C 3/0035<br>450/31 |
| 2011/0244758 | A1* | 10/2011 | Boatright | A41C 3/0035<br>450/89 |
| 2011/0287691 | A1* | 11/2011 | Hu | A41C 3/144<br>450/56 |
| 2012/0184180 | A1* | 7/2012 | Hu | A41C 3/144<br>450/55 |
| 2015/0190244 | A1* | 7/2015 | Halley | A61F 2/52<br>623/7 |
| 2015/0296895 | A1* | 10/2015 | Muir | A41C 3/0035<br>450/89 |

* cited by examiner

CROSS SECTION

CROSS SECTION

CROSS SECTION

CROSS SECTION

CELL PHONE COMPARTMENT IN MOLDED CUP

BACKGROUND

Field of Invention

The present invention relates to cell phone compartments, in particular the cell phone compartments in a molded bra cup.

Description of Prior Art

Many women store their cellular phones, such as iPhones, Android phones, or other mobile phones and other items, such as keys, money clips, or identification cards in their bra. Many women are also concerned about their appearance, especially in their bust area, which is often a focus of other people. However, placing a phone in a conventional bra could have a noticeable bulge or lines. Also, a conventional bra is not designed to have an easily accessed opening. Further, because it was not designed to hold an object such as a phone, it is possible for the object to slip out and be damaged by a fall or create an embarrassing situation. Also, the conventional bra cannot be used to store objects discreetly or easily.

What is needed bra with an integral pocket or case that is easily and discreetly accessed.

SUMMARY OF THE INVENTION

It is an objective of the present invention to provide a bra with an integral pocket or case that is easily and discreetly accessed. In some embodiments, the opening is on the outside positioned at an angle that allows easily access. In other embodiments, the bra contains a soft flexible molding that hides the shape of the object.

OBJECTS AND ADVANTAGES

Accordingly, the present invention includes the following advantages:

1. Provides a means for securely storing a phone or other object.
2. Prevents or eliminates accidentally dropping of a phone.
3. Eliminates the need to carry a purse or belt clip in which a phone is typically carried.
4. Eliminates the need to carry a phone in a pant pocket preventing damage to the phone caused by sitting.
5. Improves appearance using a pocket incorporated into a bra that presents no unsightly bulges to other observers.
6. Allows quick access to a phone.
7. Allows for hands-free use of a phone in speakerphone mode or wireless connection to a vehicle or Bluetooth headset.

DRAWING FIGURES

In the drawings, closely related figures have the same number but different alphabetic suffixes.

REFERENCE NUMERALS IN DRAWINGS

Figure 1:
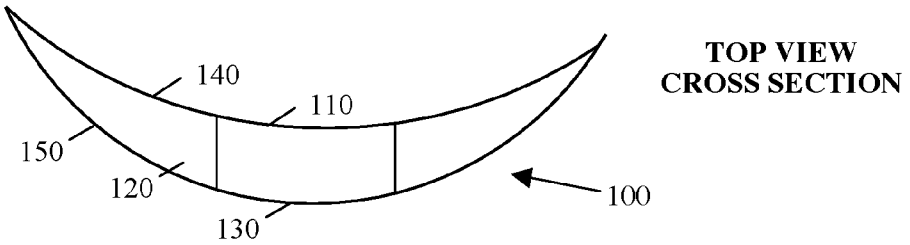
FIG. 1 shows a cross section of a bra pocket compartment.

100 molded cup
110 pocket space
120 molding
130 rigid case
140 inside
150 outside
200 bra cup
202 left cup
204 right cup
210 opening
220 pocket
230 slide hole
250 phone
300 symmetric molding
400 strap
410 shoulder strap
420 back strap
430 lateral support strap
440 centered support strap
500 natural gap
510 breast

600 bottom layer
610 top layer
700 top opening
710 channel
720 partial flap
730 full flap
800 external case
810 visible opening
900 padded pocket
910 holster

DESCRIPTION OF THE INVENTION

Bra Pocket Compartment

Figure 2A:
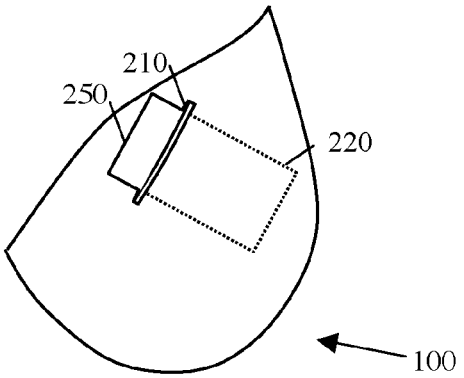
FIG. 2A shows a phone in a bra cup with a bra phone pocket.

FIG. 1 shows a cross section of a bra pocket compartment that is formed in a molded cup 100 providing a pocket space 110 in the surround molding. The molded cup 100 is shown having a smooth, convex outside surface 150. In one embodiment the pocket space 110 is surround by a rigid case 130. FIG. 2A shows a phone 250 in an embodiment of a molded cup 100 with a pocket 220. The phone 250 is shown being inserted into an opening 210.

Figure 3:
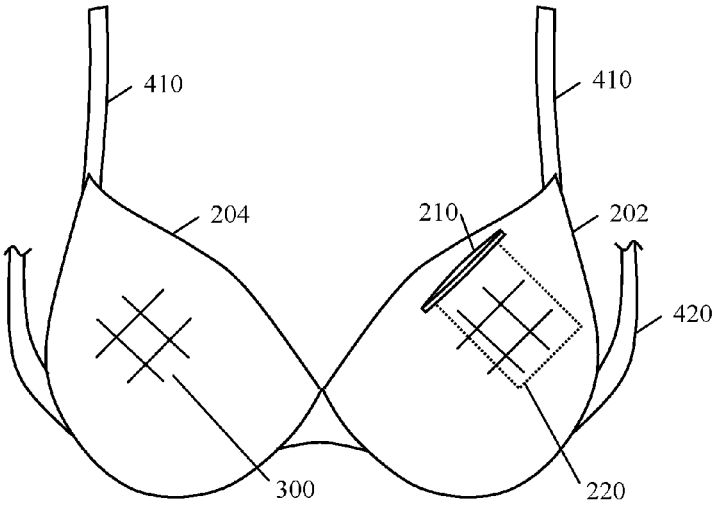
FIG. 3 shows the front of a bra with a pocket in a molded bra cup and a second bra cup with symmetrical molding.

The pocket 220 has a relative rigid yet comfortable shell so that the pocket 220 does not collapse when the phone 250 or other object is removed. The rigidness of the pocket 220 also provides for fast and easy insertion and removal. The molding 120 or padding creates a smooth transition from the conventional shape to the slightly thicker shape required to create the pocket space 110 for the phone. The molding 120 also acts as padding to increase comfort and smooth appearance on the outside surface 150 of the bra cup 200. The inside surface 140 is preferably a comfortable, breathable material. In some embodiments (not shown but similar to FIG. 10E) a pocket 220 is available in each half of the bra; while in other embodiments, the opposite half is merely padded to provide a symmetric overall shape as shown in FIG. 3.

FIG. 2A shows a left half of a bra (or left cup 202 from the wearer's perspective) having the bra pocket 220. In this example, the phone 250 is an Apple® iPhone with a generally rectangular shape. In some embodiments the pocket is matched to the shape of other phones, such as a Samsung Fascinate (Galaxy), Motorola Droid X, and so forth. In yet other embodiments the pocket is of sufficient size and shape to hold a number of different objects including flip phones, smart phones, keys, money clips, credit cards, or identification cards.

Slide Hole Opening

Figure 2B:
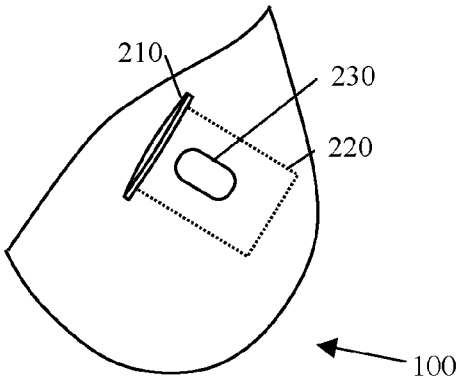
FIG. 2B shows a bra cup with an external pocket opening and a slide hole cutout which can be used to get friction on a phone with a finger to more easily remove the phone.

FIG. 2B shows a molded cup 100 with a pocket 220 having an external pocket opening 210 and a slide hole cutout 230 which can be used to get friction on a phone 250 (as shown in FIG. 2A) with a finger to more easily remove the phone. The opening is flush with the outside surface 150 so that the opening 210 is "hidden" (i.e. leaving substantially no visible disturbance on the outside surface 150).

Figure 2C:
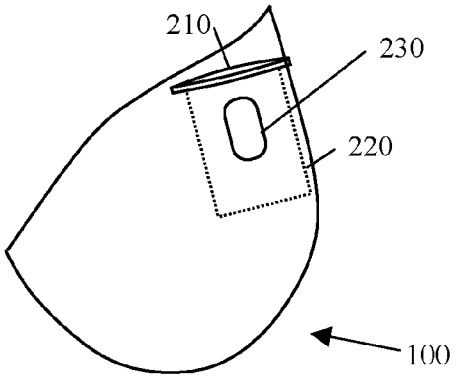
FIG. 2C shows the feature of FIG. 2B but with the pocket positioned at an angle that matches the upper outer edge of the bra cup.

FIG. 2C shows the feature of FIG. 2B but with the pocket positioned at an angle that matches the upper lateral edge of the molded cup 100. The position provides for easy access through most necklines of outer clothing and places the phone 250 near the armpit and ribs where it will be less noticeable.

Alternative Positions in a Molded Cup

Figure 2D:
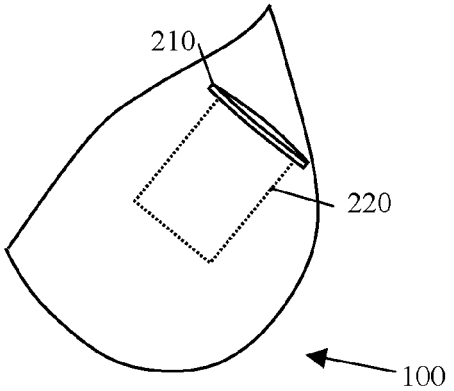
FIG. 2D shows the pocket with the external opening on the lateral side with a downward angle toward the center.

FIG. 2D shows the pocket 220 with the external opening 210 on the lateral side with a downward angle toward the center of the molded cup 100.

Figure 2E:
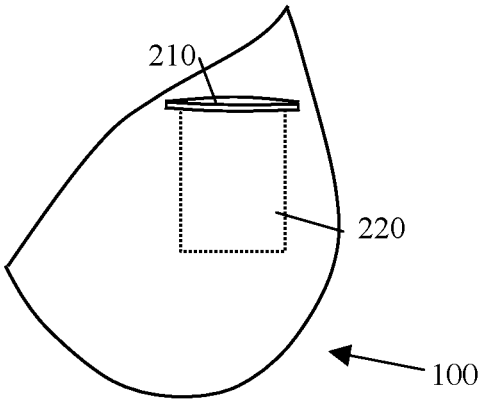
FIG. 2E shows the pocket with the external opening near the top with a vertical orientation.

FIG. 2E shows the pocket 220 with the external opening 210 near the top with a vertical orientation.

Figure 2F:
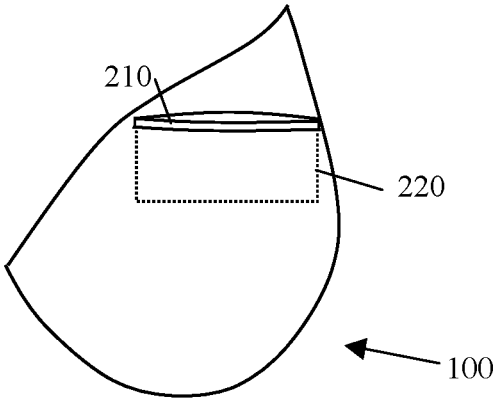
FIG. 2F shows the pocket with a wide, external opening near the top with a horizontal orientation.

FIG. 2F shows the pocket 220 with a wide, external opening 210 near the top with a horizontal orientation.

Figure 2G:
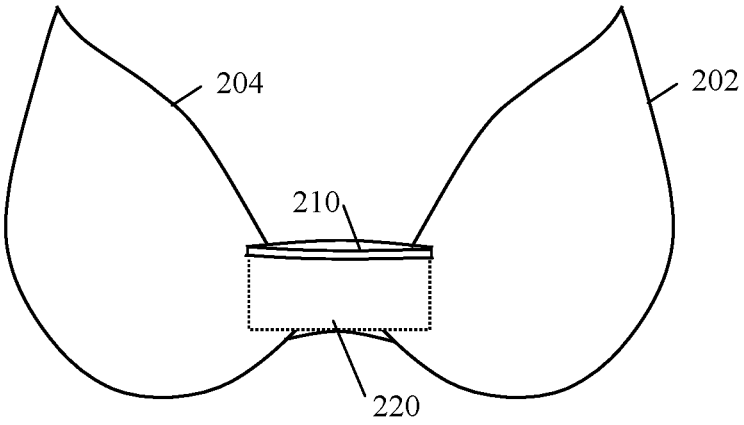
FIG. 2G shows the pocket with a wide, external opening between two bra cups with a horizontal orientation.

FIG. 2G shows the pocket 220 with a wide, external opening 210 with a horizontal orientation between two bra cups 202, 204.

Symmetrical Molding

FIG. 3 shows the front of a bra with a pocket 220 in a molded cup 100 in one bra cup 200 (e.g. a left cup 202) and a second bra cup (e.g. a right cup 204) with symmetrical molding 300. In this embodiment the opening 210 is shown on the external surface.

In this embodiment the opposite cup (e.g. right cup 204) is made with symmetric padding 300 but without the pocket space 110. Portions of shoulder straps 410 and back straps 420 portions are also shown. This feature is preferred with any embodiment which only has one pocket 220 in the bra.

Alternative Positions Including a Padded Side

Figure 4A:
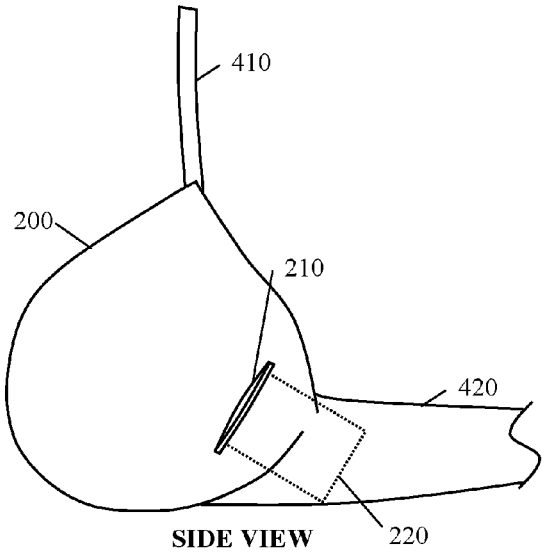
FIG. 4A shows a side view of a pocket partially in the bra cup and partially in a wide bra back strap.
Figure 4B:
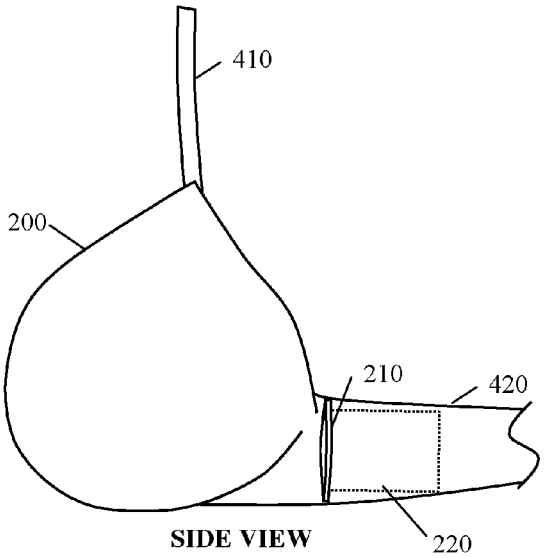
FIG. 4B shows a side view of a pocket fully in the side of a wide back strap.

FIG. 4A and FIG. 4B show alternative embodiment where the pocket is no contained full inside a bra cup 200.

FIG. 4A shows a side view of a pocket 220 partially in the bra cup 200 and partially in a wide, padded back strap 420. In this embodiment the opening 210 is near the bottom, lateral side of the bra cup 200.

FIG. 4B shows a side view of a pocket 220 fully in a wide, padded back strap 420. In this embodiment the opening 210 is in the back strap 420. This location positions the pocket 220 away from the bra cup 200 and places the phone more out of view under the arm.

Position in the Natural Gap Above the Breast

Often the shoulder straps 410 and the top half of the supporting bra cup 200 are held taut by the weight of the breast 510. This creates a natural gap 500 between curve of the top of the breast 510 and the strap 400 as shown in FIG. 5A.

Figure 5A:
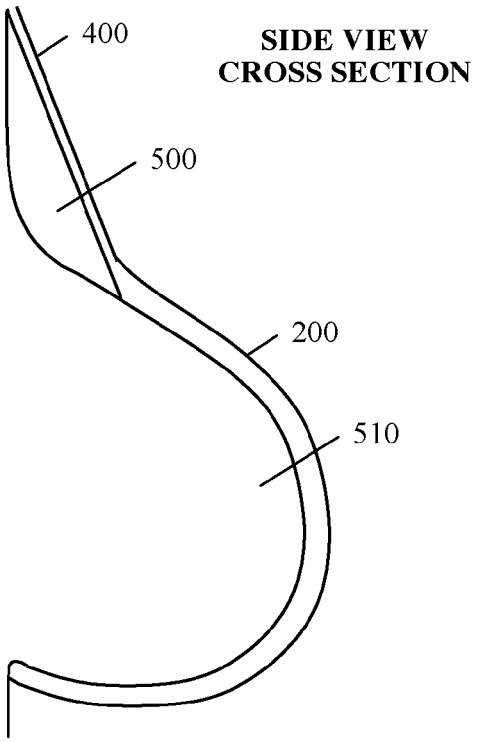
FIG. 5A shows the natural gap created between the curve of a breast and a supporting bra strap.
Figure 5B:
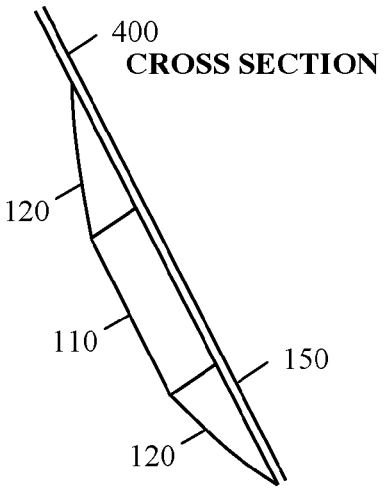
FIG. 5B shows detail of an inward protruding molding which allows the strap and the outside of the cup to remain flat while placing the pocket in the natural gap.

FIG. 5B shows detail of an inward protruding molding 120 which allows the strap 400 and the outside 150 of the cup 200 to remain flat while placing the pocket 220 in the natural gap 500. The structure of FIG. 5B would be placed in the top of the bra cup 200. For example, see FIGS. 2A, 2F, and 5C.

Preferably in any embodiment an appropriate fabric would be between the skin of the breast 510 and the pocket rigid material, so that body moisture is absorbed and the skin can breath.

Figure 5C:
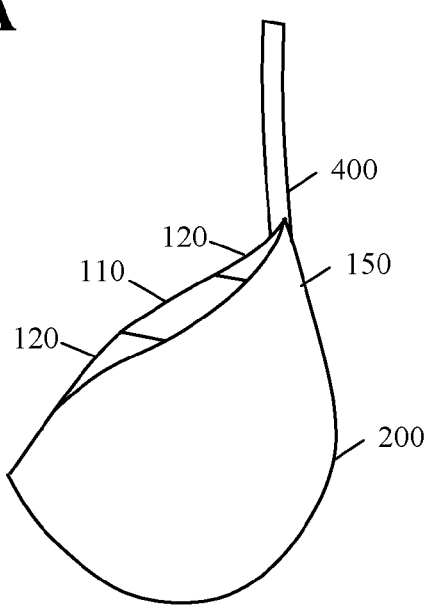
FIG. 5C shows a bra cup with the inward protruding molding which allows the strap and the outside of the cup to remain flat while placing the pocket in the natural gap.

FIG. 5C shows a bra cup with the inward protruding molding 120 which allows the strap 400 and the outside 150 of the cup 200 to remain flat while placing the pocket space 110 in the natural gap 500 (FIG. 5A).

Structure to Support the Weight of a Phone

Figure 6A:
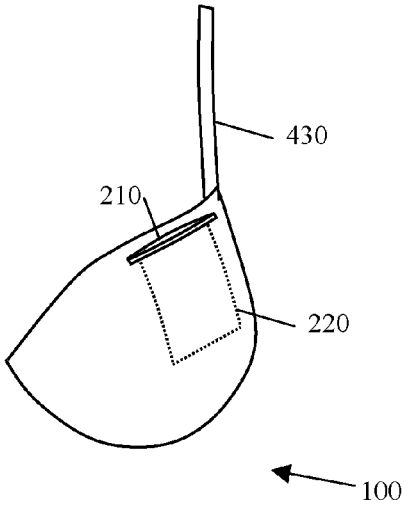
FIG. 6A shows a more petite cup with laterally positioned support with pocket and strap laterally positioned relative to the cup.
Figure 6B:
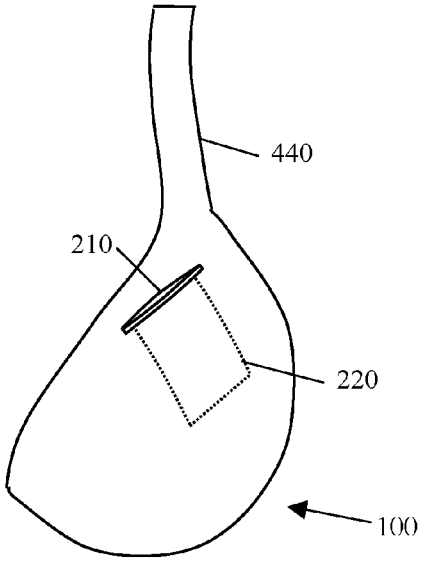
FIG. 6B shows a larger cup with a centered support strap with a more central pocket and strap.

FIG. 6A and FIG. 6B show different structures to support the weight of the phone for women of different builds.

FIG. 6A shows a more petite molded cup 100 with laterally positioned support with the pocket 220 and lateral support strap 430 laterally positioned relative to the molded cup 100. In this style for a petite wearer, the support is over the phone but lateral to match the design of the bra.

FIG. 6B shows a larger molded cup 100 with a centered support strap with a more central pocket 220 and centered support strap 440. In this style for a larger wearer, the support is over the phone to provide support for the phone while still matching the design of the bra.

Two Layer Structure to Facilitate Access

Figure 7A:
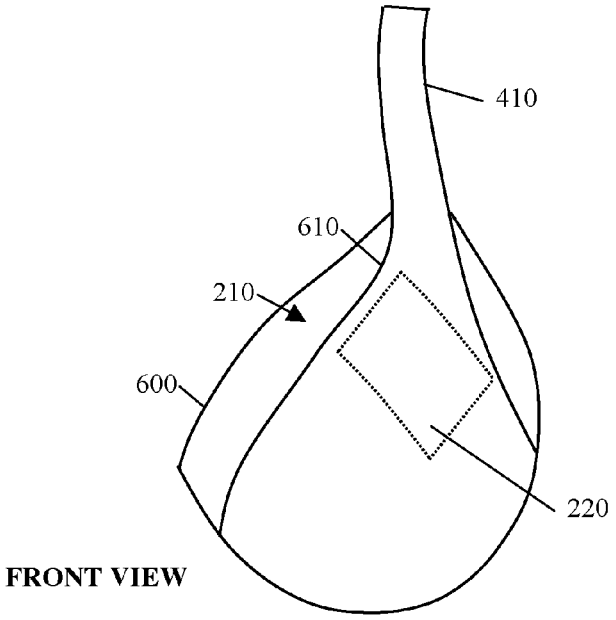
FIGS. 7A and 7B show a novel bottom layer under the top layer having a pocket between the layers, where the bottom layer is wider than the top layer allowing for easy insertion and removal of objects from the pocket.
Figure 7B:
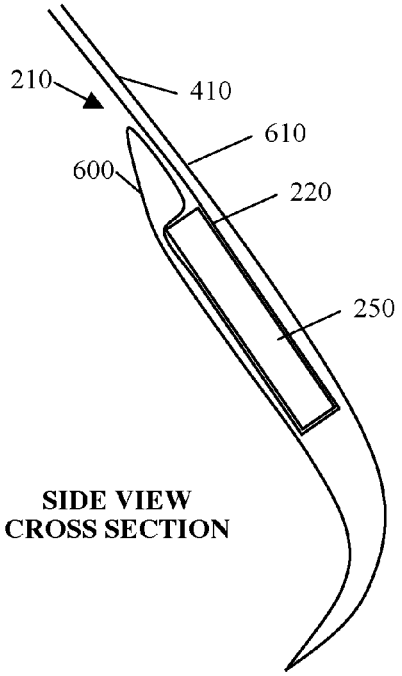

FIGS. 7A and 7B show a novel bottom layer 600 under the top layer 610 having a pocket 220 between the layers (600 and 610), where the bottom layer 600 is wider than the top layer 610 allowing for easy insertion and removal of objects from the pocket 220. The bottom layer 600 and top layer 610 form an interlayer opening 210 which conceals the pocket 220 but provides improved access. FIG. 7B shows the phone 250 after it has been inserted between the layers (600 and 610). The wearer can easily place their fingers on the medial edge of the bottom layer 600 and insert their hand under the top layer 610 to access the opening 210 to retrieve the phone. In the preferred embodiment the shoulder strap 410 is attached to the top layer 610 so that no lines are visible on the outside surface.

Alternative Opening Structures

Figure 8A:
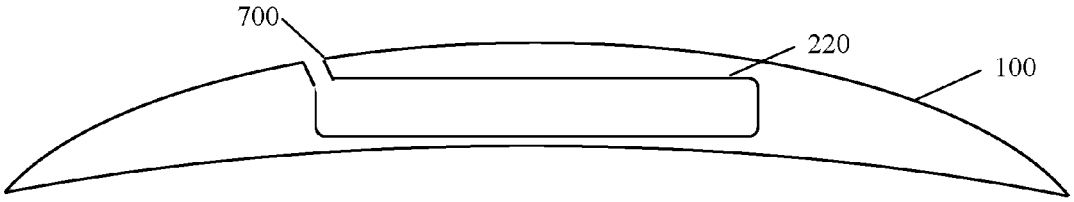
FIGS. 8A, 8B and 8C show alternative openings in the top, under a partial flap, or on the bottom under a full flap.
Figure 8B:
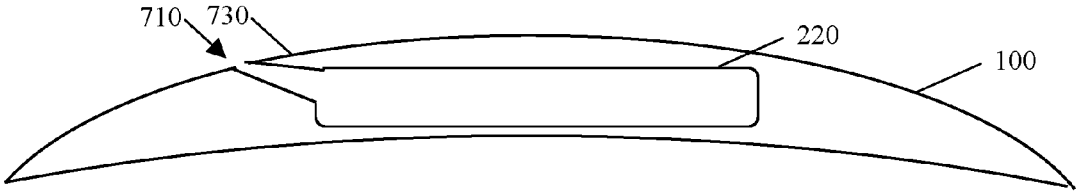
Figure 8C:
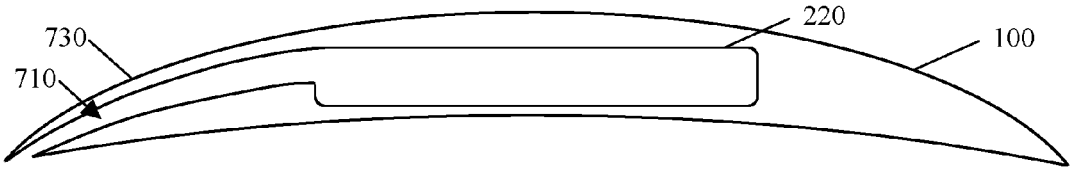

FIGS. 8A, 8B and 8C show alternative openings 210 in the top 700, under a partial flap 720, or on the interior under a full flap 730, respectively.

FIG. 8A shows an pocket 220 in a molded cup 100 having a top opening 700 which is on the outside 150 to the bra cup 200.

FIG. 8B shows an pocket 220 in a molded cup 100 having a partial flap 720 which is on the outside 150 to the bra cup 200, and which conceals the opening 220 leaving no visible lines. A channel 710 is formed by the partial flap 720 which allows for access to the phone.

FIG. 8C shows an pocket 220 in a molded cup 100 having a full flap 730 which fully conceals the opening 220 leaving no visible lines. A channel 710 is formed by the full flap 720 which allows for access to the phone from the inside 140 of the bra cup 200.

Radiation Protection

Some users are concerned about possible negative effects of having a radio frequency transmitter such as found in a cell phone close to their body. In some embodiments the rigid case 130 could be formed of a conductive material that forms a Gaussian shield between the phone 250 and the wearer's body, i.e. breast 510. If needed, an antennae connects the phone to the outside surface 150 on the external side of the protective shield, so that incoming calls or messages can be detected while still providing protection.

External Case

While an object of the previously disclosed embodiments is to avoid the detection of the phone 250 and the phone pocket 220 with molding or padding and structure to avoid showing visible lines, there are users who will want to show phone pocket as a fashion statement.

Figure 9:
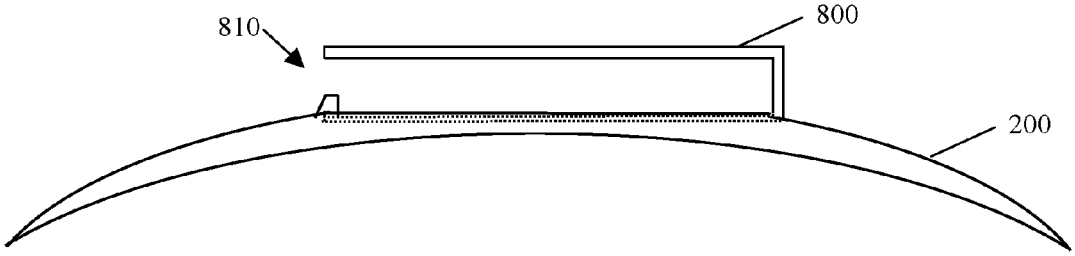
FIG. 9 shows an external case with a visible opening.

FIG. 9 shows an external case 800 attached to the bra cup 200 with a visible opening 810. This embodiment could employ the protective shield feature and the external visibility would promote its awareness.

Separate Multipurpose Pocket

While an object of the previously disclosed embodiments is to provide a variety of bras that have built-in pockets, this requires a wearer to purchase multiple bras to take advantage of the invention on a regular basis. It would also limit the choices of the user and increase the number of products to be manufactured and stocked by distribution channels. A separate multipurpose padded pocket 900 is next disclosed that can be used with a user's existing bras, or as part of a separate shoulder holster 910.

Figure 10A:
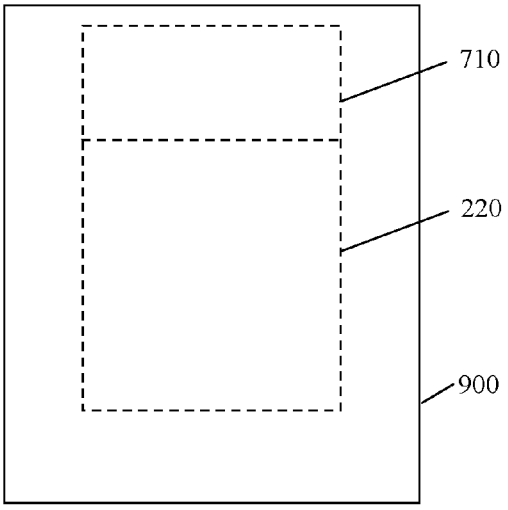
FIG. 10A shows a standalone padded pocket.
Figure 10B:
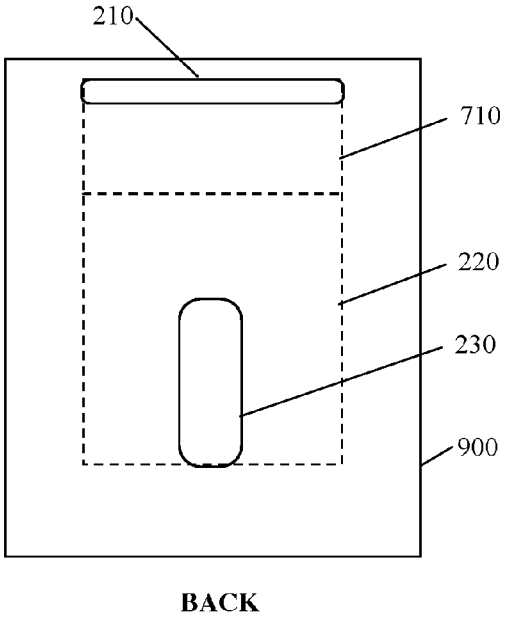
FIG. 10B shows the back of the standalone padded pocket having an opening and a slide hole.

FIG. 10A shows a standalone padded pocket 900 having a pocket and a hidden channel 710. FIG. 10B shows the back of the standalone padded pocket 900 having a opening 210 connected to the pocket 220 via the channel 710. FIG. 10B also shows an optional slide hole 230. The standalone, padded pocket 900 is shown with a substantially rectangular shape, but would preferably have rounded corners. This embodiment of the standalone padded pocket 900 has the cross section shown in FIG. 8C, but the other configurations such as FIG. 8A or FIG. 8B could alternatively be used in other embodiments. The standalone, padded pocket 900 is similar to the molded cup 100 but can be inserted under any number of conventional bras.

Figure 10C:
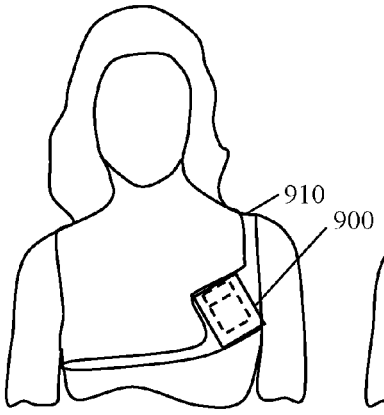
FIG. 10C shows the standalone padded pocket integrated with a shoulder holster.

FIG. 10C shows the standalone padded pocket 900 integrated with a shoulder holster 910. This embodiment could be used by men or women and does not require wearing a bra.

Figure 10D:
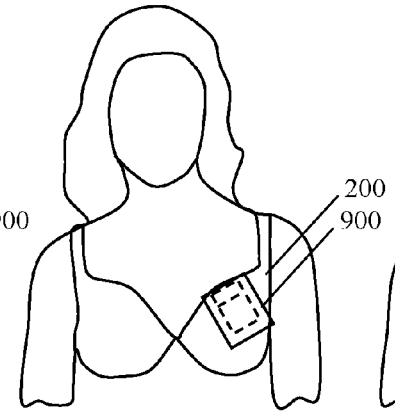
FIG. 10D shows the standalone padded pocket inserted under a convention bra cup.

FIG. 10D shows the standalone padded pocket 900 inserted under one conventional bra cup 200.

Figure 10E:
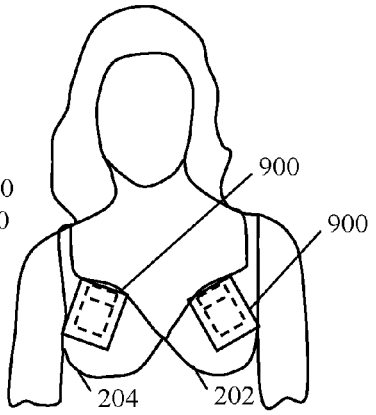
FIG. 10E shows two standalone padded pockets inserted under both conventional bra cups.

FIG. 10E shows two standalone padded pockets 900 inserted under both conventional bra cups (202 and 204).

ADVANTAGES

Improved Appearance

The bra phone improves appearance using a pocket incorporated into a bra that presents no unsightly bulges or lines to other observers.

Easy Access

The bra phone pocket provides easy access to the phone, as it is always in reach during most activities. If seated, the wearer does not have stand up.

Improved Protection

The bra phone pocket eliminates the need to carry a phone in a pant pocket preventing damage to the phone caused by sitting. It keeps the phone in a location that is not generally going to encounter external impact.

Improved Location Awareness

The bra phone pocket places the phone in a location that the wearer can readily ascertain whether or not the phone is in the pocket. This will reduce the loss of phones.

Secure Carriage

The bra phone pocket provides a more secure means for carrying a phone than the convention means. It prevents eliminates accidentally dropping of a phone.

The bra phone pocket provides for listening to music while exercising.

Reduction in Things to Carry

The bra phone pocket eliminates the need to carry a purse or belt clip in which a phone is typically carried.

Hands-Free Use

The bra phone pocket allows for hands-free use of a phone in speakerphone mode.

Conclusion, Ramification, and Scope

Accordingly, the reader will see that the improved, universal, role and discipline based, low cost means and method of object identification are easy to use, quicker and reusable and can be used with any object or individual to provide up-to-date pertinent information using methods such as on screen instructions, checklists, videos, pictures, diagrams, etc. or any combination thereof.

While the above descriptions contain several specifics these should not be construed as limitations on the scope of the invention, but rather as examples of some of the preferred embodiments thereof. Many other variations are possible. The variations could be used without departing from the scope and spirit of the novel features of the present invention.

Accordingly, the scope of the invention should be determined not by the illustrated embodiments, but by the appended claims and their legal equivalents.

We claim:

1. A system for securely and comfortably carrying a cell phone while being worn by a user, the system comprising:

a) a molded cup formed of a molded material, and b) a bra having the molded cup integrated into at least one bra cup, the molded cup comprising:

i) a pocket space, ii) the molded material on at least five sides of the pocket space, the molded material forming a smooth outside convex surface of the molded cup, the molded material forming an inside concave surface of the molded cup, and iii) an opening for inserting the cell phone into the pocket space and for removing the cell phone from the pocket space, wherein the molded cup is a single structure formed of the molded material with the pocket space formed within the single structure, wherein the molded cup conceals the cell phone when being carried in the pocket space, and wherein the molded cup securely holds the cell phone when inserted in the pocket space.

2. The system of claim 1, wherein the opening is on the inside concave surface of the molded cup.

3. The system of claim 1, wherein the opening is on the outside convex surface of the molded cup.

4. The system of claim 3, wherein the molded cup further comprises a finger access slide hole, whereby the user touches the phone through the finger access slide hole and moves the phone toward the opening.

5. The system of claim 1, wherein the molded cup having the pocket space forms a first cup of the bra, and wherein a second cup of the bra comprises a second molded cup formed of separate molded material to symmetrically match an external shape of the first cup, being a mirror image of the external shape of the first cup.

6. A system for securely carrying a cell phone while being worn by a user, the system comprising a wearable molded cup formed of a molded material, the molded cup comprising:

i) a pocket space, ii) the molded material around the pocket space, the molded material forming a smooth outside convex surface for the molded cup, and iii) an opening for inserting the cell phone into the pocket space and for removing the cell phone from the pocket space, wherein the molded cup is a single structure formed of the molded material with the pocket space formed within the single structure, wherein the molded cup conceals the cell phone when being carried in the pocket space, when the system is worn by the user, wherein the molded cup securely holds the cell phone when inserted in the pocket space.

7. The system of claim 1, wherein the pocket space is positioned directly below a shoulder strap, wherein the cell phone is supported directly from above, whereby the smooth appearance of the bra is maintained.

8. The system of claim 1, wherein the at least one bra cup further comprises:

i) a bottom layer of material attached to the inside concave surface of the molded cup, and ii) a top layer of material attached to the outside convex surface of the molded cup, wherein the bottom layer is wider than the top layer, wherein the bottom layer extends beyond an edge of the molded cup, and wherein the bottom layer and the top layer form the opening.

9. The system of claim 1, wherein the molded cup further comprises a channel between the opening and the pocket space, wherein the pocket space is positioned centrally in the molded cup, wherein the opening is positioned between a perimeter of the pocket space and a perimeter of the molded cup, wherein the channel forms a passage through the molded material, wherein a portion of the molded material between the channel and the outside convex surface forms a flap, and wherein the flap conceals the opening and the channel, providing a smooth closure.

10. The system of claim 1, wherein the molded cup further comprises a case that forms a boundary of the pocket space, wherein the case comprises a thin layer of material which is less flexible than the molded material, wherein the case substantially maintains the shape of the pocket space when the cell phone is removed from the pocket space.

11. The system of claim 1, wherein the molded cup further comprises a protective shield between the cell phone and the user, wherein the protective shield comprises a thin layer of conductive material that forms a Gaussian shield.

12. The system of claim 6, wherein the molded material and the pocket space form an inward protrusion configured to be positioned above a breast of the user.

13. The system of claim 6 further comprising a shoulder holster connected to the molded cup, the shoulder holster comprising a shoulder strap for suspending the molded cup from at least one shoulder of the user, wherein the cell phone is supported directly from above.

14. The system of claim 6 further comprising a bra having the molded cup integrated into a first bra cup.

15. The system of claim 14, the bra having a second molded cup integrated into a second bra cup, wherein the second molded cup is formed of separate molded material to symmetrically match an external shape of the first bra cup, being a mirror image of the external shape of the first bra cup.

16. The system of claim 1, wherein molded material is foam.

17. The system of claim 1, wherein molded material is silicone.

18. The system of claim 6, wherein molded material is foam.

19. The system of claim 6, wherein molded material is plastic.

20. A bra for securely and comfortably carrying a cell phone while being worn by a user, the bra comprising:

a) two bra cups, each bra cup having an outside convex surface, and b) a case comprising a thin layer of material, connected to one outside convex surface of one of the two bra cups, the case forming a pocket space, and the case having an external opening connected to the pocket space, wherein the opening is for inserting the cell phone into the pocket space and for removing the cell phone from the pocket space, wherein the case is external to the one bra cup to which the case is connected, and wherein the case securely holds the cell phone when inserted into the pocket space through the external opening.

* * * * *